US007156711B2

(12) United States Patent
Hutchings

(10) Patent No.: US 7,156,711 B2
(45) Date of Patent: Jan. 2, 2007

(54) OUTBOARD MOTOR ENCLOSURE AND SECURITY ARRANGEMENT THEREFOR

(76) Inventor: Gary W. Hutchings, 17 Stanwood Ave., Gloucester, MA (US) 01915

( * ) Notice: Subject to any disclaimer, the term of this patent is extended or adjusted under 35 U.S.C. 154(b) by 25 days.

(21) Appl. No.: 10/970,593

(22) Filed: Oct. 21, 2004

(65) Prior Publication Data

US 2006/0089061 A1 Apr. 27, 2006

(51) Int. Cl.
*B63H 19/00* (2006.01)
*B16K 35/10* (2006.01)

(52) U.S. Cl. ..... 440/113; 114/361; 440/71; 416/247 A

(58) Field of Classification Search ..... 114/361; 440/113, 71; 416/247 R, 247 A
See application file for complete search history.

(56) References Cited

U.S. PATENT DOCUMENTS 2,822,183 A * 2/1958 Montgomery ..... 280/47.131
4,998,496 A * 3/1991 Shaw, III ..... 114/222
5,137,481 A * 8/1992 Wengler ..... 440/77
5,469,721 A * 11/1995 Pyle ..... 70/14
5,660,136 A * 8/1997 Pignatelli et al. ..... 114/361
5,791,955 A * 8/1998 Rinck ..... 440/113

* cited by examiner

*Primary Examiner*—Sherman Basinger
(74) *Attorney, Agent, or Firm*—Don Halgren

(57) ABSTRACT

A multi-purpose mariner safety and motor housing arrangement for the secure enclosure of the lower drive unit of an inboard/outboard or outboard motor for a boat. The multi-purpose housing preferably comprises a left half housing and a right half housing hingedly connected along a front edge thereof. The left half housing and the right half housing are arranged to lockably enclose a lower drive unit of a motor. The housing arrangement encloses a plurality of accessible, watertight sub enclosures disposed within the left and the right half housings for safe containment of emergency gear therewithin, to provide floatation and safety to mariners even when the housing is removed from the motor.

14 Claims, 4 Drawing Sheets

OUTBOARD MOTOR ENCLOSURE AND SECURITY ARRANGEMENT THEREFOR

BACKGROUND OF THE INVENTION

1. Field of the Invention

This invention relates to protective enclosures for outboard motors, and more particularly to enclosures which provide multiple safety configurations, including for the motor, for the safety of the boat and safety of mariners using the boat because of the construction and compartments of the motor enclosure arrangement related to safety gear.

2. Prior Art

Security of a boat and the safety of its occupants are ongoing problems for mariners. Small boats which utilize an inboard/outboard or an outboard motor are easily damaged and usually easily stolen. These motors may be damaged when they're lower units, which include the propellers, are left angled on the stern of a boat, with the propeller out of the water. Not only that, these exposed propellers and lower shaft of the motor may swing into neighboring boats at any mooring.

There have been a number of attempts at providing some sort of enclosure for outboard motor propulsion units, such as shown in U.S. Pat. No. 5,791,955 to Rinck which shows a lockable housing for such a motor. U.S. Pat. No. 5,494,465 to Jenkins shows a propeller housing for an outboard motor. U.S. Pat. No. 5,469,721 to Pyle shows a propeller case and lock arrangement for an inboard/outboard motor.

The prior art is deficient however in providing multi functional enclosures and safety arrangements for mariners on the boat during use of the boat, while otherwise also protecting the outboard motor (and boat) during on-use of the boat.

It is an object of the present invention to overcome the disadvantages of the prior art.

It is a further object of the present invention to provide a multi-functional unit which encloses the lower portion of an outboard motor or an inboard/outboard motor while maximizing safety considerations for the boat and the mariner.

It is yet still a further object of the present invention, to provide an enclosure arrangement for an outboard motor and safety apparatus along with multiple enclosure capabilities for further safety equipment.

BRIEF SUMMARY OF THE INVENTION

The present invention relates to an enclosure arrangement for the lower unit of an outboard motor. The outboard, which may be also considered an inboard/outboard, is mounted on the stern of a boat. When the boat and motor are not in use, typically the motor is tipped about a hinge on the stern of the boat, so as to lift the propeller out of the water.

The enclosure of the present invention comprises a left half-housing and a right half-housing which completely enclose the lower unit of the outboard motor or an inboard/outboard motor, including its propeller.

The left half housing and the right half housing have a forward or front end which are joined together by an elongated hinge arranged thereat. The left half housing and the right half housing each have an upper elongated planar surface. When the left half housing and the right half housing are closed together, between them they have an oval shaped opening centrally disposed through that upper planar surface. The generally oval shaped opening is arranged to receive the lower unit of the motor.

The left half housing and the right half housing each have a rear panel. The left half housing has a lower curvilinear edge with an opening arranged at its lowermost portion. The right half housing has a corresponding lowermost curvilinear edge with a corresponding opening at its lowermost portion. When the left half housing and the right half housing are closed together in a mating relationship, the lowermost hole portions define a drain hole on the lowermost portion of the enclosure unit.

The left half housing has a side panel with an enlarged bulbous portion extending therefrom. The right half housing has a side panel with an enlarged bulbous portion also extending therefrom. The two bulbous side panels provide the width necessary for the enclosure unit to fully enclose the propeller adjacent the lower end of the lower unit of the motor.

A generally rectilinear watertight enclosure is formed in the upper portion of the left half housing. The side panel and the upper panel thereof comprise side portions of that waterproof enclosure. A similar waterproof enclosure is arranged on the uppermost side of the right half housing. The watertight half right half enclosure and the watertight left half enclosure provide storage space for emergency equipment such as flares and first aid kits and other necessary items for a mariner.

A further watertight enclosure is arranged on the rear panel of the left half housing. In a preferred embodiment of the present invention, a light, such as for example a strobe light, is arranged on the rear panel of the left half housing. A battery and/or a timing device and/or an on/off switch in this preferred embodiment, is arranged within the watertight compartment inside of the rear panel of the left half housing.

The right half housing has a corresponding rear panel with a lock arrangement therewith. The lock arrangement on the rear panel of the right half housing on one preferred embodiment thereof, comprises a plurality of linked hooks which each pivot about an axis so as to engage a corresponding hook receiving opening on a flange extending inwardly from the rear panel on the left half housing.

In yet a further embodiment of the present invention, the left half housing and the right half housing may have a closed-cell liner on their interior surfaces thereof which surfaces are exposed to the lower unit of the motor. Those closed cell plastic linings may have tapered depressions which generally conform to the shape characteristics of the lower portion of the motor.

Thus what has been shown as a unique motor enclosure, preferably made of an injectable plastic material, which in a further preferred embodiment, may have side wall components made of a fluorescent material, for safely housing and making the housing highly visible when it covers the lower unit of an outboard motor or an inboard/outboard motor unit or a boat. Such an enclosure housing includes sub enclosures for safety equipment such as a strobe light or the like to provide a warning signal to other mariners who may be entering a mooring area after dark. Such an enclosure unit also provides a flotation means because of its watertight sub enclosure compartments which are also used for storage gear such as flares, first aid kits, food or the like. Such flotation may also be assisted by the closed cell foam liner on each inside portion of the left half housing and the right half housing.

Water is permitted to escape through the drain hole in the lowermost portion of the two joined halves. The elongated hinge on the forward end of the enclosure housing, permits easier access to and safe removal of the enclosure unit from the lower unit of the outboard unit. The strobe light and locking arrangement on the rear portion of the enclosure unit is readily accessible and provides security as well as safety to the boat, to the motor and to other mariners in the area of the boat to which the enclosure is attached.

The invention thus comprises a multi-purpose housing arrangement for the secure enclosure of the lower drive unit of an inboard/outboard or outboard motor for a boat, to also function as a theft-deterrent of same. The multi-purpose housing preferably comprises a left half housing and a right half housing hingedly connected along a front edge thereof. The left half housing and the right half housing are arranged to lockably enclose a lower drive unit of a motor.

A plurality of accessible, watertight sub enclosures are preferably disposed within the left and the right half housings for safe containment of emergency gear therewithin. A controllable safety light such as for example, a strobe light with an on/off switch located within the housing, or activated by a timer and powered by batteries or solar cells located on the top of the housing and communicating with that light, which light is preferably arranged on a rear panel of at least one of the half housings to provide a proximity warning to mariners about the motor and the boat.

A lock arrangement is disposed on a rear panel of one of the half housings, and is securable to a rear panel on the other of the half housings to permit the half housings to be locked together, and to permit the half housings to be unlocked to expose the motor and provide access to the sub enclosures within the half housings.

The housings may include a bulbous side panel on each of the half housings to provide sufficient width of the housings for a lower drive unit enclosed therewithin. A semi-circular opening may be arranged along a lower edge on each of the half housings to provide a complete drain hole opening for water caught within the housing arrangement when the half housings are joined together. An inner lining may be arranged on the inner side of each half housing formed of a closed cell foam, the inner linings having a formed inner surface arranged to conform to the shape of a lower drive unit of a motor.

The lock arrangement may comprise in one example, a plurality of correspondingly pivotable hooks mounted on a member of one of the panels, which hooks are arranged to pivot into and out of lockable engagement with an arrangement of corresponding openings on a member of the other of the panels. The sub-enclosures are preferably openable only when the half housings are removed from the lower drive unit of a motor.

The controllable safety light, powered by a battery or solar cells, may have an automatic timer connected therewith to turn on the light after dusk, and to turn off the light upon daylight, or be turned on/off by a switch on or in the housing ennclosure. The left half housing and the right half housing are preferably connected by an elongated hinge so as to provide ease of alignment during closure of the half housings against one another. The housing arrangement preferably comprises a floatation device for emergency use, because of its watertight sub enclosures and closed cell foam lining therein. The safety light is preferably a strobe light.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
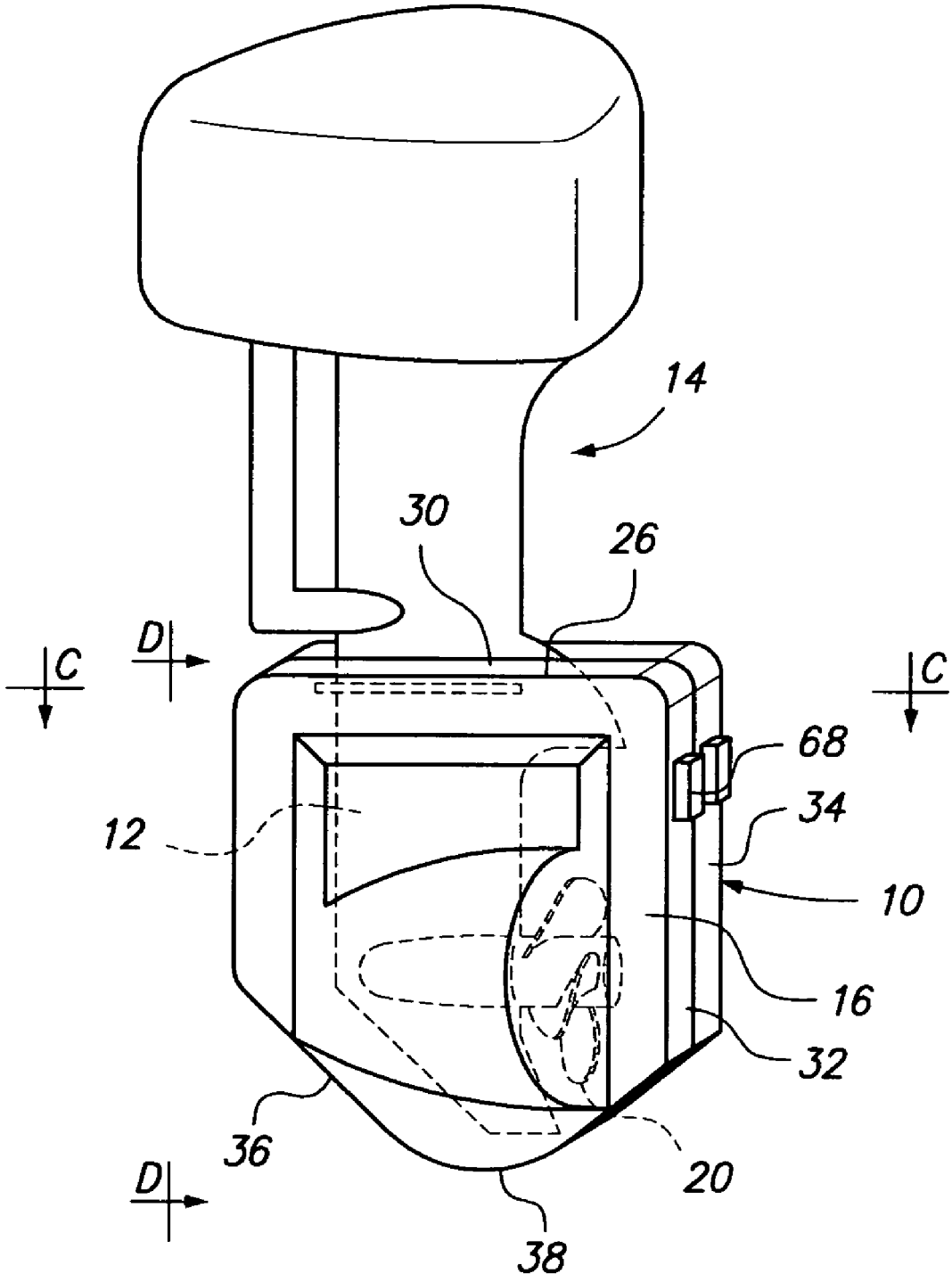
FIG. 1 is a perspective view of an outboard motor having a lower unit enclosed by the enclosure housing of the present invention.
Figure 2:
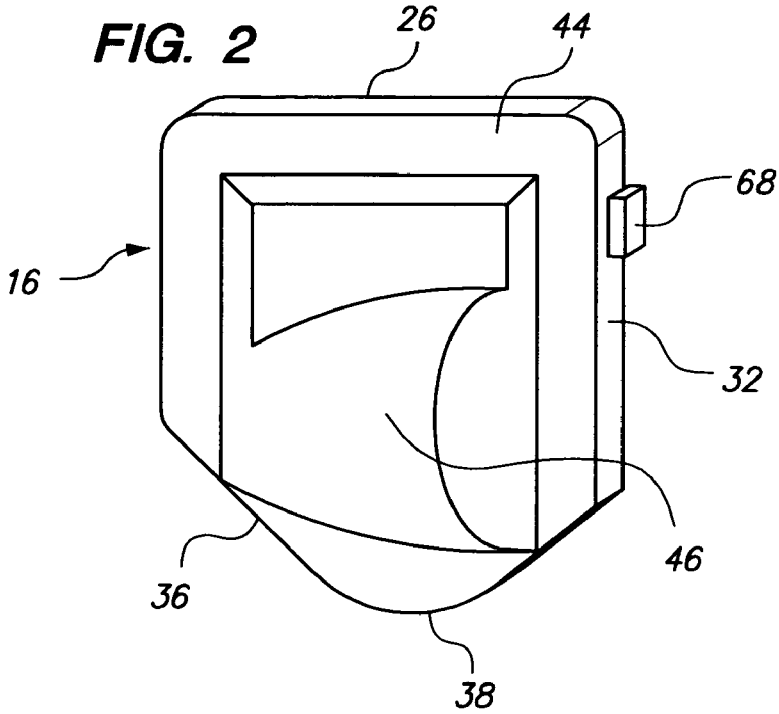
FIG. 2 is a side elevational view of the left half housing of the present invention.

Referring now to the drawings in detail, and particularly to FIG. 1, there is shown the present invention which comprises a multi-function, anti-theft and mariner-safety motor-enclosure arrangement 10 for the lower unit 12 of for example, an outboard motor 14. The outboard 14, which may be also considered an inboard/outboard, is mounted on the stern of a boat, not shown for clarity of drawing. When the boast and motor are not in use, typically the motor 14 is tipped about a hinge on the stern of the boat (not shown for clarity of drawings) so as to lift the propeller out of the water.

The enclosure 10 of the present invention comprises a left half-housing 16 and a right half-housing 18 which completely enclose the lower unit 12 of the outboard motor or an inboard/outboard motor 14, including its propeller 20.

Figure 3:
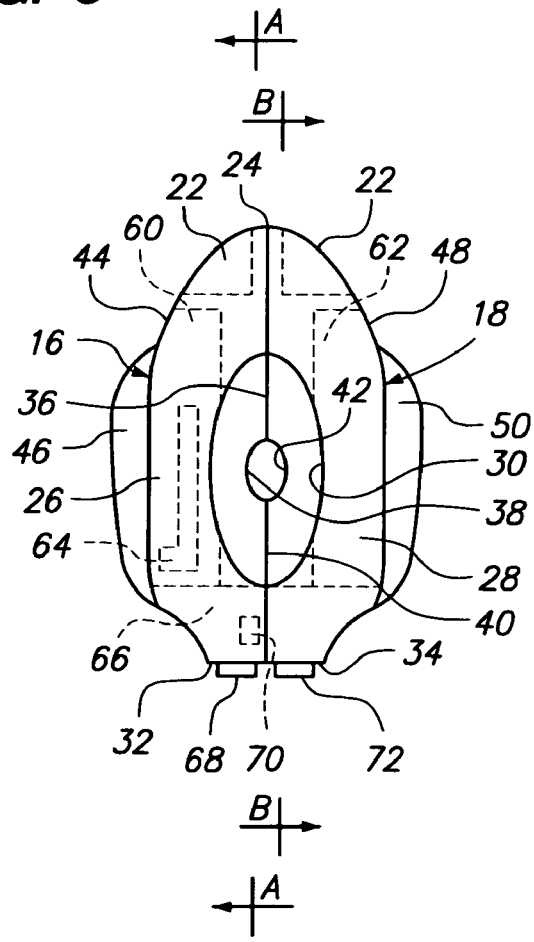
FIG. 3 is a view taken along the lines C—C of FIG. 1.
Figure 6:
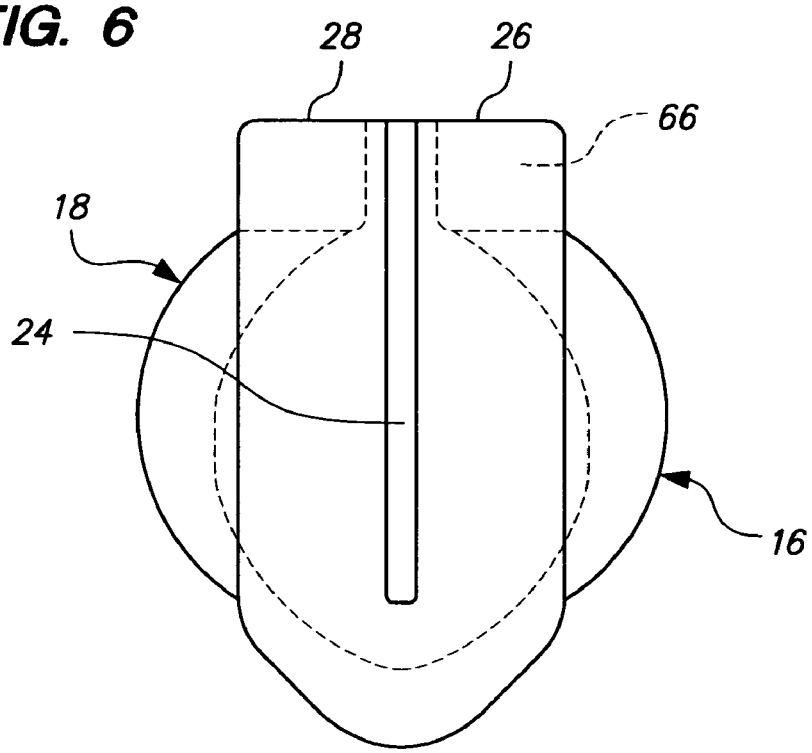
FIG. 6 is a front elevational view of the combined left and right halves, as taken along the lines D—D of FIG. 1.

The left half housing 16 and the right half housing 18 each have a forward or front end 22 which are joined together by an elongated hinge 24, arranged thereat, as represented in FIGS. 3 and 6. The left half housing 16 and the right half housing 18 each have an upper elongated planar surface 26 and 28, respectively. When the left half housing 16 and the right half housing 18 are closed together, as best represented in FIG. 3, between them they have an oval shaped opening 30 centrally disposed through the upper planar surfaces 26 and 28. The generally oval shaped opening 30 is arranged to receive the lower unit of the motor 14, as best represented in FIG. 1.

The left half housing 16 and the right half housing 18 each have a rear panel 32 and 34 respectively. The left half housing 16 has a lower curvilinear edge 36 with a semicircular opening 38 arranged at its lowermost portion. The right half housing 18 has a corresponding lowermost curvilinear edge 40 with a corresponding semicircular opening 42 at its lowermost portion. When the left half housing 16 and the right half housing 18 are closed together in a mating relationship, the lowermost hole portions 38 and 42 define a drain hole on the lowermost portion of the enclosure unit 10.

The left half housing 16 has a side panel 44 with an enlarged bulbous portion 46 extending therefrom. The right half housing 18 has a side panel 48 with an enlarged bulbous portion 50 extending from its panel 48. The two bulbous side panels 46 and 50 between one another provide the width necessary for the enclosure unit 10 to fully enclose the propeller 20 adjacent the lower end of the lower unit 12 of the motor 14.

Figure 4:
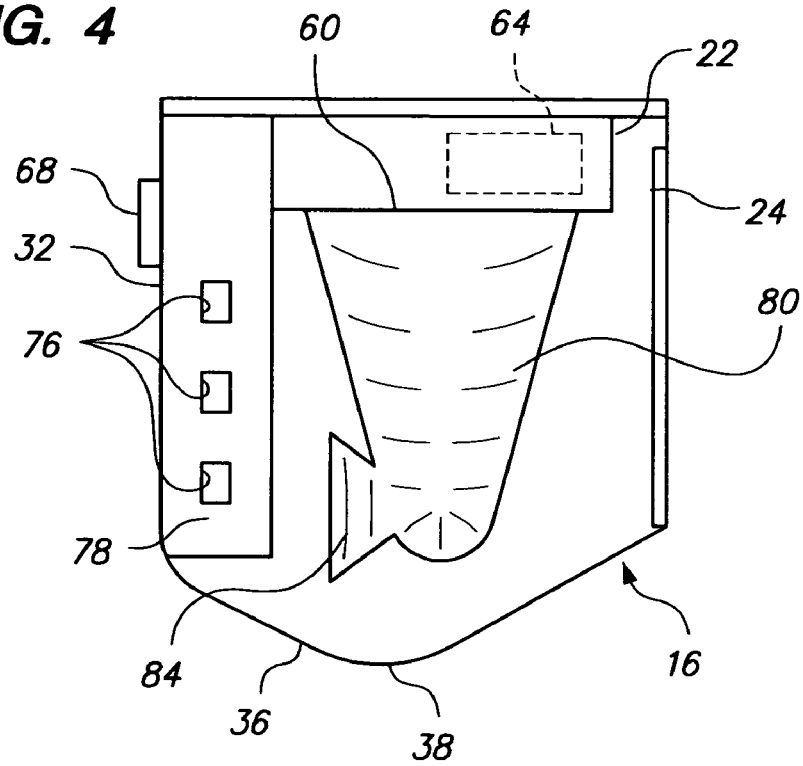
FIG. 4 is a side elevational view of the left-half enclosure, as taken along the lines B—B of FIG. 3.
Figure 5:
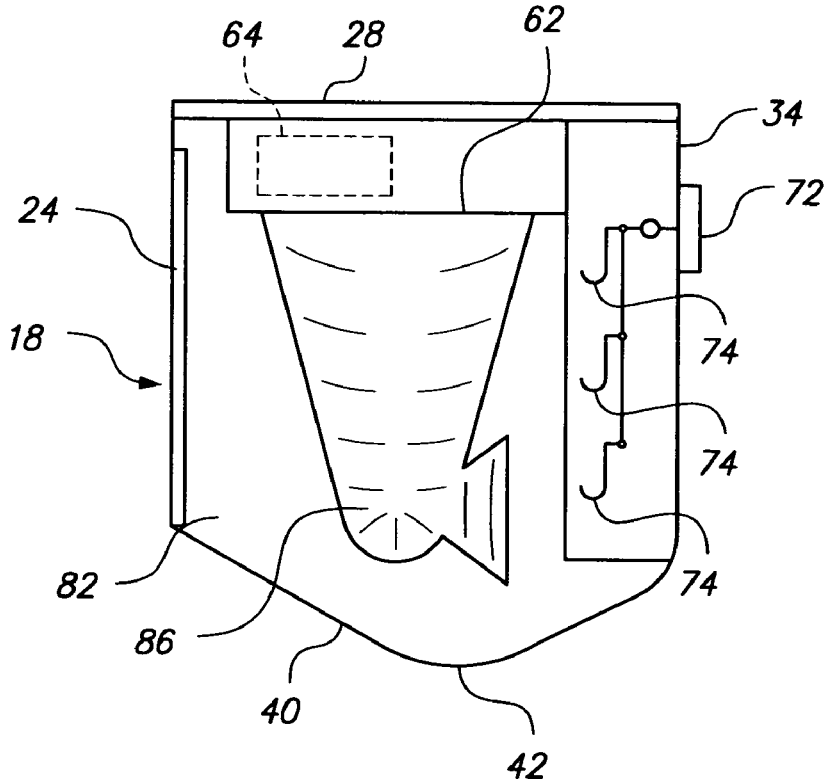
FIG. 5 is a side elevational view of the right-half enclosure, as taken along the lines A—A of FIG. 3.

A generally rectilinear, openable watertight enclosure 60 is formed in the upper portion of the left half housing 16, as represented in FIGS. 3, 4 and 5. The side panel 44 and the upper panel 26 thereof comprise side portions of that accessible, openable waterproof enclosure 60. A similar openable, waterproof enclosure 62 is arranged on the uppermost side of the right half housing 18. The watertight half right half enclosure 62 and the watertight left half enclosure 60 provide easy, accessible storage space for emergency equipment 64 such as flares and first aid kits and other necessary items for a mariner through watertight doors, not shown for clarity of the drawings. The watertight enclosures 60 and 62 amongst others, also permit the respective housings 16 and 18 to also be utilized as supplemental personal emergency floatation devices once they have been removed from the motor 14.

A further accessible, watertight enclosure 66 is arranged on the rear panel 32 of the left half housing 16. In a preferred embodiment of the present invention, a light, such as for example a strobe light 68, is arranged on the rear panel 32 of the left half housing 16. A battery and/or a timing device and/or an on/off switch 70 in this preferred embodiment, is arranged within the accessible, watertight compartment 66 inside thereof, or the switch 70 may otherwise be arranged outside of the rear panel 32 of the left half housing 16, as represented in FIGS. 2, 3, 4 and 7.

Figure 7:
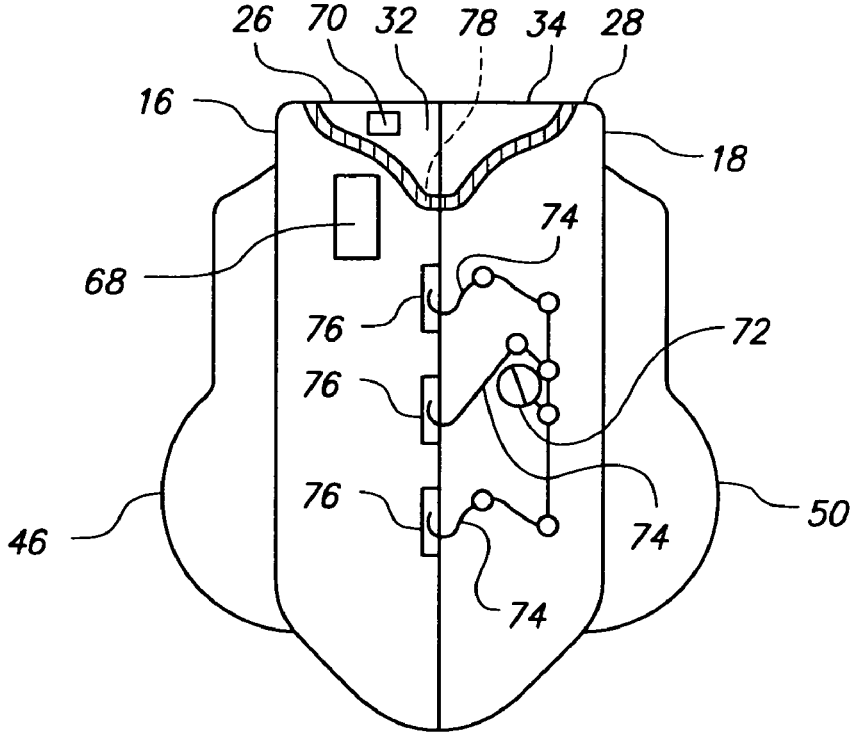
FIG. 7 is a rear elevational view of the enclosure housing with portions of the rear panel cut away to show components of the locking mechanism thereof.

The right half housing 18 has a corresponding rear panel 34 with a lock arrangement 72 therewith, as represented in FIGS. 3, 5 and in a cut-away view show in FIG. 7. The lock arrangement 72 on the rear panel 32 of the right half housing 18 on one preferred embodiment thereof, for example, comprise a plurality of linked hooks 74 which each pivot about an axis so as to engage a corresponding hook receiving opening 76 on a flange 78 extending inwardly from the rear panel 32 on the left half housing 16, as part of the enclosure 66 thereat.

In yet a further embodiment of the present invention, the left half housing 16 and the right half housing 18 may have a closed-cell liner 80 and 82 respectively, on their interior surfaces thereof which surfaces are exposed to the lower unit 12 of the motor 14. Those closed cell plastic linings 80 and 82 may have tapered depressions 84 and 86 which generally conform to the shape characteristics of the lower portion 12 of the motor 14, as represented in FIGS. 4 and 5.

Thus what has been shown as a unique multi-function motor enclosure, preferably made of an injectable plastic material, all of or portions of which may be fluorescent, for safely housing the lower unit of an outboard motor or an inboard/outboard motor unit or a boat, and for providing floatation and visibility to the boat, the motor, and or mariners who may need to use the enclosure housing for personal safety. Such an enclosure housing includes sub enclosures for safety equipment such as a strobe light or the like to provide a warning signal to other mariners who may be entering a mooring area after dark. Such an enclosure unit also provides a personal flotation device means because of its watertight sub enclosure compartments which are also used for storage gear such as flares, first aid kits, food or the like. Such flotation may also be assisted by the closed cell foam liner on each inside portion of the left half housing and the right half housing.

Water is permitted to escape through the drain hole in the lowermost portion of the two joined halves. The elongated hinge on the forward end of the enclosure housing, permits easier access to and safe removal of the enclosure unit from the lower unit of the outboard unit. The strobe light and locking arrangement on the rear portion of the enclosure unit is readily accessible and provides security as well as safety to the boat, to the motor and to other mariners in the area of the boat to which the enclosure is attached.

I claim:

1. A multi-purpose mariner-safety and motor housing arrangement for the secure enclosure of the lower drive unit of an inboard/outboard or outboard motor for a boat, said multi-purpose housing comprising:

a left half housing and a right half housing hingedly connected along a front edge thereof, said left half housing and said right half housing arranged to lockably enclose a lower drive unit of a motor; and a plurality of accessible, watertight floatation device enclosures built within said left and right half housings for safe containment of emergency gear therewithin, said left and right half housings comprising emergency floatation devices because of said watertight enclosures built therewithin.

2. The multi-purpose housing arrangement as recited in claim 1, including:

a controllable safety light arranged on a rear panel of at least one of said half housings to provide a proximity warning to mariners about said motor.

3. The multi-purpose housing arrangement as recited in claim 2, including:

a lock arrangement disposed on a rear panel of one of said half housings, and securable to a rear panel on the other of said half housings to permit said half housings to be locked together, and to permit said half housings to be unlocked to expose said motor and provide access to said enclosures built within said half housings.

4. The multi-purpose housing arrangement as recited in claim 3, including;

a bulbous side panel on each of said half housings to provide width of said housings for a lower drive unit enclosed therewithin.

5. The multi-purpose housing arrangement as recited in claim 4, including;

a semi-circular opening along a lower edge on each of said half housings to provide a complete drain hole opening for water caught within said housing arrangement when said half housings are joined together.

6. The multi-purpose housing arrangement as recited in claim 5, including;

an inner lining on the inner side of each half housing formed of a closed cell foam, said inner linings having a formed inner surface arranged to conform to the shape of a lower drive unit of a motor.

7. The multi-purpose housing arrangement as recited in claim 6, wherein said lock arrangement comprises a plurality of correspondingly pivotable hooks mounted on a member of one of said panels, which hooks are arranged to pivot into and out of an arrangement of corresponding openings on a member of the other of said panels.

8. The multi-purpose housing arrangement as recited in claim 3, wherein said enclosures are openable only when said half housings are removed from a lower drive unit of a motor.

9. The multi-purpose housing arrangement as recited in claim 2, wherein said controllable safety light has an automatic timer connected therewith to turn on said light after dusk, and to turn off said light upon daylight.

10. The multi-purpose housing arrangement as recited in claim 9, wherein said safety light is a strobe light.

11. The multi-purpose housing arrangement as recited in claim 1, wherein said left half housing and said right half housing are connected by an elongated hinge so as to provide ease of alignment during closure of said half housings against one another.

12. The multi-purpose housing arrangement as recited in claim 1, wherein said housing arrangement comprises a floatation device for emergency use, because of its water-tight sub enclosures and closed cell foam lining therein.

13. The multi-purpose housing arrangement as recited in claim 1, wherein at least a portions of said left and right half housings are formed at least partially of a fluorescent material.

14. The multi-purpose housing arrangement as recited in claim 1, wherein said left and right half housings comprise personal floatation devices.

* * * * *